US007974069B2

(12) United States Patent
Mao et al.

(10) Patent No.: US 7,974,069 B2
(45) Date of Patent: Jul. 5, 2011

(54) INDUCTIVE AND CAPACITIVE COMPONENTS INTEGRATION STRUCTURE

(75) Inventors: Saijun Mao, Shanghai (CN); Yingqi Zhang, Shanghai (CN); Xiaoming Yuan, Shanghai (CN)

(73) Assignee: General Electric Company, Niskayuna, NY (US)

( * ) Notice: Subject to any disclaimer, the term of this patent is extended or adjusted under 35 U.S.C. 154(b) by 251 days.

(21) Appl. No.: 12/260,447

(22) Filed: Oct. 29, 2008

(65) Prior Publication Data

US 2010/0103585 A1 Apr. 29, 2010

(51) Int. Cl.

| | |
|---|---|
| ***H01H 9/28*** | (2006.01) |
| *H01H 27/00* | (2006.01) |
| *H01H 47/00* | (2006.01) |
| *H01H 63/00* | (2006.01) |

(52) U.S. Cl. ..... 361/270; 361/268

(58) Field of Classification Search ..... 361/270
See application file for complete search history.

(56) References Cited

U.S. PATENT DOCUMENTS

| | | | | |
|---|---|---|---|---|
| 4,368,407 | A | 1/1983 | Wroblewski | |
| 4,766,365 | A * | 8/1988 | Bolduc et al. | 323/308 |
| 5,619,400 | A * | 4/1997 | Bowman et al. | 363/15 |
| 6,246,209 | B1 | 6/2001 | Kim | |
| 6,249,093 | B1 | 6/2001 | Takahata et al. | |
| 6,348,848 | B1 * | 2/2002 | Herbert | 336/178 |
| 6,528,859 | B2 | 3/2003 | Odendaal | |
| 6,529,363 | B2 | 3/2003 | Waffenschmidt et al. | |
| 6,664,606 | B2 | 12/2003 | Estes | |
| 7,113,066 | B2 | 9/2006 | Waffenschmidt | |
| 2004/0108311 | A1 | 6/2004 | de Rooij | |
| 2005/0052271 | A1 | 3/2005 | Nakatsu et al. | |
| 2006/0197511 | A1 * | 9/2006 | Af Klercker Alakula | 323/247 |
| 2006/0220777 | A1 | 10/2006 | Nakahori | |

FOREIGN PATENT DOCUMENTS

| | | | |
|---|---|---|---|
| WO | WO02093593 | | 11/2002 |
| WO | W02006118473 | A1 | 11/2006 |
| WO | W02008084757 | A1 | 7/2008 |
| WO | W02008101367 | A1 | 8/2008 |

OTHER PUBLICATIONS

PCT International Search Report dated Jun. 29, 2010.

* cited by examiner

*Primary Examiner* — Dharti H Patel
(74) *Attorney, Agent, or Firm* — Jason K. Klindworth

(57) ABSTRACT

An inductive and capacitive components integration structure includes a magnetic core including a first and a second outer leg, and a third inner leg between the first and second outer legs, a first and a second winding respectively wound on the first and second outer legs, and a third winding wound on the third inner leg. The first and second windings are electrically coupled and comprise a first inductive winding. The first inductive winding does not generate any effective magnetic flux through the third inner leg. The third winding forms a second inductive winding. At least one of the first, second and third windings is a composite winding and comprises at least one embedded capacitor.

22 Claims, 4 Drawing Sheets

INDUCTIVE AND CAPACITIVE COMPONENTS INTEGRATION STRUCTURE

BACKGROUND

Embodiments of the invention relate to electronic components, and more particularly, to an electronic passive component structure integrating at least an inductive and a capacitive component.

Electronic passive components, integrating inductive and capacitive components, are advantageous for the demand of ever-decreasing profile. Passive integration will enable the incorporation of the inductive component and the capacitive component into a single structure. The inductive components may be inductors or transformers.

Various structures, such as inductor-inductor-capacitor (L-L-C), inductor-capacitor-transformer (L-C-T) and inductor-inductor-capacitor-transformer (L-L-C-T) structures, are generally fabricated by integrating capacitors with inductors and/or transformers. The inductive components and capacitive components are generally designed dependently, which is disadvantageous for further reducing the integration structure profile.

SUMMARY

An aspect of the invention resides in an inductive and capacitive components integration structure. The inductive and capacitive components integration structure includes a magnetic core including a first and a second outer leg, and a third inner leg between the first and second outer legs, a first and a second winding respectively wound on the first and second outer legs, and a third winding wound on the third inner leg. The first and second windings are electrically coupled and comprise a first inductive winding. The first inductive winding does not generate any effective magnetic flux through the third inner leg. The third winding forms a second inductive winding. At least one of the first, second and third windings is a composite winding and comprises at least one embedded capacitor.

Another aspect of the invention resides in an inductive and capacitive components integration structure. The inductive and capacitive components integration structure includes a magnetic core. The magnetic core includes a first and a second outer leg, and a third inner leg between the first and second outer legs. The first and second outer legs are symmetric about the third inner leg. A first and a second winding are wound on the third inner leg, and the first and second windings are electrically coupled to each other and being configured such that magnetic flux respectively generated by the first and second windings is substantially equal and opposite, and at least one of the first and second windings comprises an embedded capacitor. The integration structure further includes an inductive winding wound on the magnetic core.

Still another aspect of the invention resides in an inductive and capacitive component integration structure. The integration structure includes a magnetic core including a first leg, a second leg and a third leg, and a first and a second winding wound around the first and second legs respectively. The third leg is substantially solid and without a winding, such that magnetic flux generated by the first and second windings flows through the third leg. The magnetic flux respectively generated by the first and second windings does not influence each other.

Still another aspect of the invention resides in an inductive and capacitive component integration structure. The integration structure includes a magnetic core including a first leg, a second leg and a third leg, the first, second, third legs each comprising an air gap. A first and a second inductive winding are respectively wound around the first and second legs. Magnetic flux generated by the first and second inductive windings partially flows through the third leg and the first and second inductive windings at least partially magnetically decoupled.

These and other advantages and features will be more readily understood from the following detailed description of preferred embodiments of the invention that is provided in connection with the accompanying drawings.

BRIEF DESCRIPTION OF DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF PREFERRED EMBODIMENTS

Figure 1:
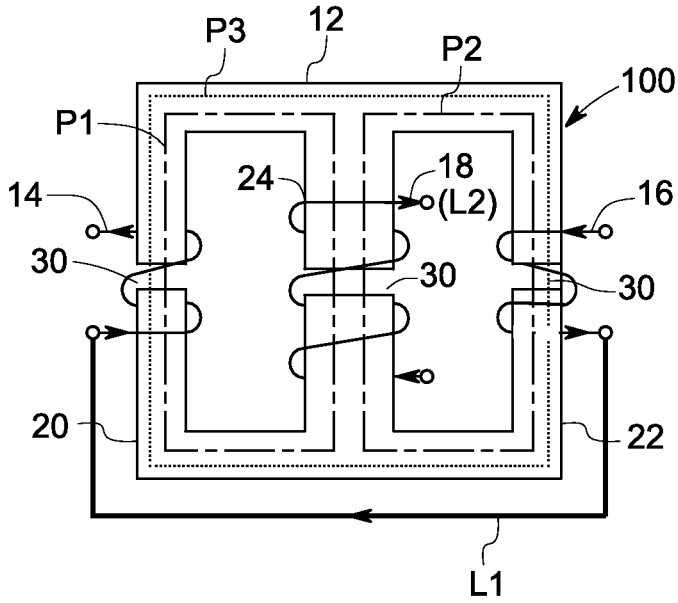
FIG. 1 illustrates an exemplary L-L-C integration structure according to one embodiment of the invention.

Referring to FIG. 1, an inductive and capacitive component integration structure 100 is shown in accordance with one embodiment of the invention. The integration structure 100 includes a magnetic core 12, and a first winding 14, a second winding 16 and a third winding 18 wound on the magnetic core 12. The magnetic core 12 includes a first outer leg 20 and a second outer leg 22, and a third inner leg 24 between the first and second outer legs 20, 22. The first outer leg 20 and the third inner leg 24 together form a first close-loop magnetic path P1. The second outer leg 22 and the third inner leg 24 together form a second close-loop magnetic path P2. The first outer leg 20 and the second outer leg 22 together form a third close-loop magnetic path P3. The first and second windings 14, 16 are electrically coupled to form a first inductive winding L1. The third winding 18 forms the second inductive winding L2.

The third winding 18 is wound on the third inner leg 24. The first and second windings 14, 16 are respectively wound on the first and second outer legs 20, 22. Magnetic flux, generated by the illustrated first winding 14, flows through the first and third close-loop magnetic paths P1 and P3. Magnetic flux, generated by the illustrated second winding 16, flows through the second and third close-loop magnetic paths P2 and P3.

The magnetic flux generated by the first winding 14 flows through the third inner leg 24 in a first direction and with a first magnitude. The magnetic flux generated by the second winding 16 flows through the third inner leg 24 in a second direction and with a second magnitude. The first and second windings 14, 16 are arranged in a manner such that the first and second directions are opposite to each other, while the first and second magnitudes are substantially equal to each other. In this way, the first and second windings 14, 16, i.e. the first inductive winding L1, will not generate any effective magnetic flux on the third winding 18 on the third inner leg 24. Additionally, the magnetic flux generated by the third winding 18, i.e. the second inductive winding L2, flows through the first and second close-loop magnetic paths P1 and P2. In the illustrated embodiment, magnetic flux through the first outer leg 20 from the third winding 18 is in opposite direction with the magnetic flux generated by the first winding 14, while magnetic flux through the second outer leg 22 from the third winding 18 is in the same direction with the magnetic flux. Accordingly, the third winding 18, i.e. the second inductive winding L2, will not generate any effective magnetic flux on the first inductive winding L1.

In certain embodiments, the first and second outer legs 20, 22 are symmetric about the third inner leg 24. In certain embodiments, the first and second windings 14 and 16 are printed wirings with the same number of winding layers and the same number of turns for each layer. The distance between each layer, of the first and second windings 14 and 16, is the same. The distance between each turn, of the first and second windings 14 and 16, is the same.

Figure 2:
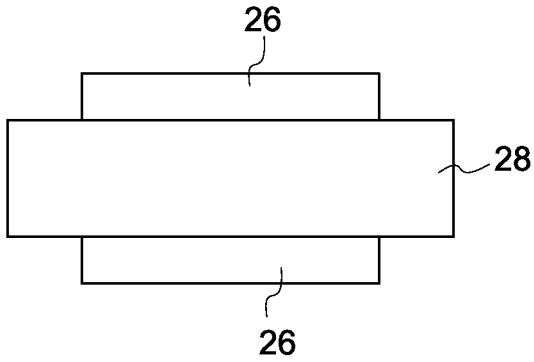
FIG. 2 is a cross-sectional view of a composite winding according to an embodiment of the invention.

In certain embodiments, at least one of the first winding 14, second winding 16, and third winding 18 is a composite winding including at least one embedded capacitor. FIG. 2 illustrates a cross sectional view of a composite winding. The composite winding includes a dielectric layer 28 with conductive windings 26 on opposite sides. In certain embodiments, the conductive windings 26 are attached to opposite sides of the dielectric layer 28 by a lamination process.

In certain embodiments, the dielectric layer 28 is made from a material having a high dielectric constant, such as ferroelectric ceramic and embedded capacitor laminates, to generate large capacitance. The conductive windings 26 can be made from a conductive material with good electrical conductivity, such as copper. The magnetic core 12 can be a soft-ferrite core, a planar core or an other type of core.

In certain embodiments, each of the first and second outer legs 20, 22 and the third inner leg 24 has an air gap 30. As previously mentioned, the first and second windings 14, 16 may be electrically coupled, and thus the first and second windings 14, 16 together may function as a first inductor L1. The third winding 18 may form a second inductor L2. Accordingly, the first winding 14, the second winding 16, the third winding 18 and the magnetic core 12 together form an L1-L2-C integration structure. In certain embodiments, the first winding 14, the second winding 16 and the third winding 18 are all composite windings, respectively including an embedded capacitor C1, C2, and C3. The first winding 14, the second winding 16 and the third winding 18 and the magnetic core 12 together form an L1-L2-C1-C2-C3 integration structure.

Figure 3:
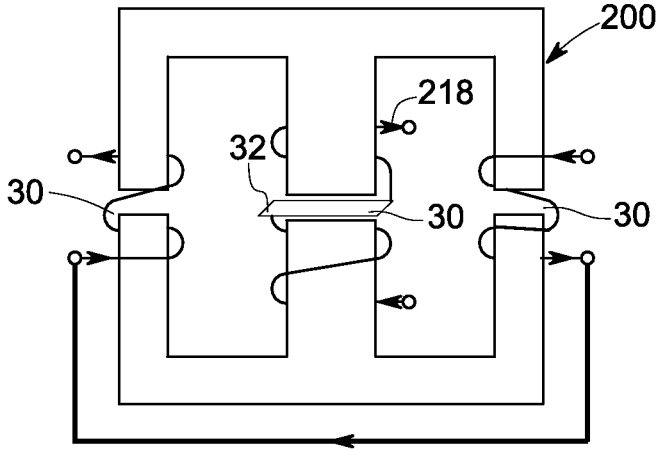
FIG. 3 illustrates an L-L-C integration structure according to another embodiment of the invention.

FIG. 3 shows an inductive and capacitive component integration structure 200 according to another embodiment of the invention. In the illustrated embodiment, a third winding 218 includes two parts electrically coupled with each other via a printed circuit board 32 placed in the air gap 30. The two parts can instead be electrically coupled via other electrical connectors.

Figure 4:
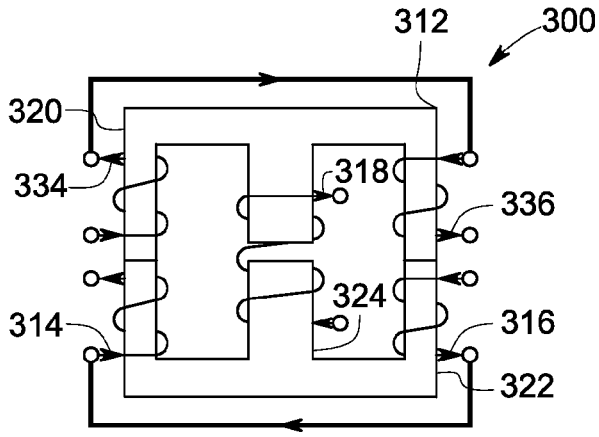
FIG. 4 illustrates an L-C-T integration structure according to still another embodiment of the invention.

FIG. 4 illustrates an integration structure 300 according to still another embodiment of the invention. As illustrated, the integration structure 300 includes an integrated L-C-T structure on a shared magnetic core 312. The magnetic core 312 includes a first outer leg 320 and a second outer leg 322, and a third inner leg 324 between the first and second outer legs 320, 322. The integration structure 300 includes a first and a second winding 314, 316 respectively wound on the first and second outer legs 320, 322. A third winding 318 is wound on the third inner leg 324. The first and second windings 314, 316 are arranged in a manner such that magnetic flux respectively generated by the first and second windings 314, 316 is substantially decoupled from the third inner leg 324. The integration structure 300 further includes a fourth and a fifth winding 334, 336 respectively wound on the first and second outer legs 320, 322. The fourth and fifth windings 334, 336 are arranged in a manner such that magnetic flux respectively generated by the first and second windings 314, 316 is substantially decoupled on the third inner leg 324. The first and second windings 314, 316 are electrically coupled and together form a primary side of a transformer T. The fourth and fifth windings 334, 336 are electrically coupled and together form a secondary side of the transformer T. The third winding 318 forms an inductive winding L. In the illustrated embodiment, the transformer T and the inductive winding L are magnetically decoupled from each other. In one embodiment, at least one of the first, second, third, fourth and fifth windings is a composite winding with an embedded capacitor C thus forming an integrated the L-C-T structure 300.

Figure 5:
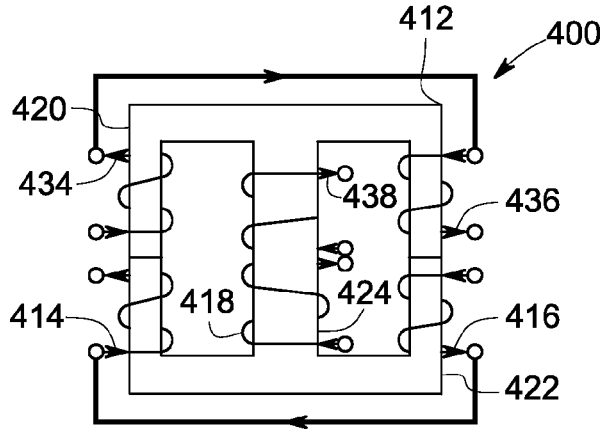
FIG. 5 illustrates a T-T-C integration structure according to still another embodiment of the invention.

Referring to FIG. 5, an integration structure 400 according to still another embodiment of the invention is illustrated. More specifically, an integrated T-T-C structure is illustrates using magnetic core 412. The integration structure 400 includes a first and a second winding 414, 416 respectively wound on a first and second outer legs 420, 422. A third winding 418 is wound on a third inner leg 424. The first and second windings 414, 416 are arranged in a manner such that magnetic flux respectively generated by the first and second windings 414, 416 is substantially decoupled on the third inner leg 424. The integration structure 400 further includes a fourth and a fifth winding 434, 436 respectively wound on the first and second outer legs 420, 422. The fourth and fifth windings 434, 436 are arranged in a manner such that magnetic flux respectively generated by the fourth and fifth windings 434, 436 is substantially decoupled on the third inner leg 424. The first and second windings 414, 416 are electrically coupled and together form a primary side of a first transformer T1. The fourth and fifth windings 434, 436 are electrically coupled and together form a secondary side of the first transformer T1. The integration structure 400 further includes a sixth winding 438. The third and sixth windings 418, 438 respectively form primary and secondary windings of a second transformer T2. As such, the first and second transformer T1 and T2 do not generate any effective flux to each other, and thus are substantially decoupled. At least one of the first, second, third, fourth and fifth windings is a composite winding with an embedded capacitor C. In such an embodiment, an integrated T1-T2-C structure 400 is formed.

Figure 6:
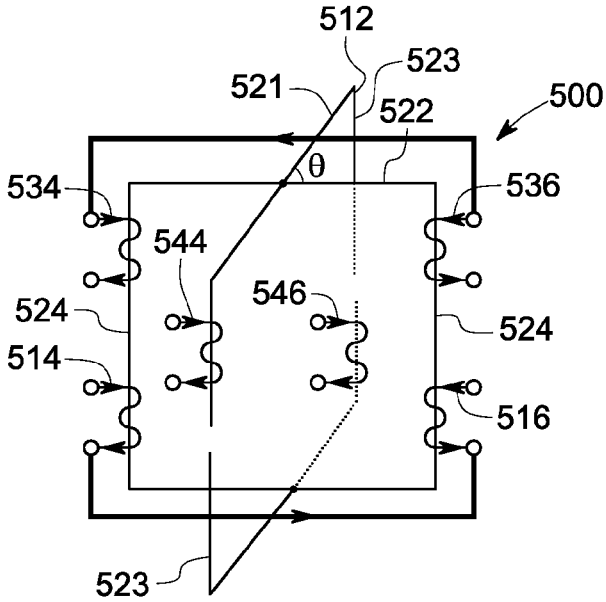
FIG. 6 illustrates a multi-L-C-T integration structure according to still another embodiment of the invention.

Referring to FIG. 6, an integration structure 500 according to still another embodiment of the invention is shown. The integration structure 500 includes a substantially three-dimensional magnetic core 512. The magnetic core 512 includes a first and a second core part 521, 522 that intersect with each other to form a three-dimensional cross shape. In one embodiment, the first and second core parts 521, 522 intersect each other to form a right angle θ, however other angular relationships between the core parts are also possible. Each of the first and second core parts 521, 522 includes two lateral legs 523 and 524. In one embodiment, the second core part 522 includes a first winding 514, a second winding 516, a fourth winding 534, and a fifth winding 536 on the two lateral legs 524, thus forming a transformer T that is similar to those described in the embodiments shown in FIGS. 4 and 5. A sixth and a seventh winding 544 and 546 are respectively wound on the two lateral legs 523 of the first core part 521. The illustrated first, second, fourth and fifth winding arrangement is further magnetically decoupled from the first core part 521, and thus magnetic flux generated will not affect the sixth and seventh windings 544 and 546 on the second core part 522. At least one of the first, second, fourth, fifth, sixth and seventh windings is a composite winding with an embedded capacitor C.

Figure 7:
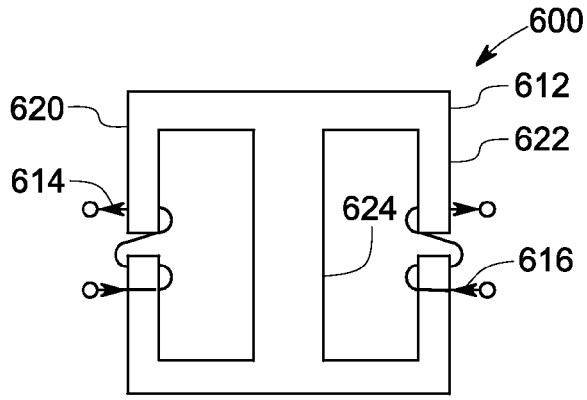
FIG. 7 illustrates an L-L-C integration structure according to still another embodiment of the invention.

Referring to FIG. 7, an integration structure 600 according to still another embodiment of the invention is shown. The integration structure 600 includes a magnetic core 612. The magnetic core 612 includes a first, a second and a third leg 620, 622, 624. The integration structure 600 further includes a first and second winding 14, 16 respectively wound on the first and second legs 620, 622. At least one of the first and second windings 614, 616 is a composite winding with an embedded capacitor C. The third leg 624 is substantially solid without an air gap and without a winding. As such, magnetic flux generated by the first and the second windings 614, 616 respectively flows through the third leg 624, and thus the magnetic flux generated by the first and second legs will not affect each other. In certain embodiments (as shown in FIG. 7), each of the first and the second outer legs has an air gap, such that the first and second windings 614, 616 respectively function as an inductor. In other embodiments (not shown in FIG. 7), wherein the first and the second legs 620, 622 respectively includes a transformer similar to that shown in FIG. 6.

Figure 8:
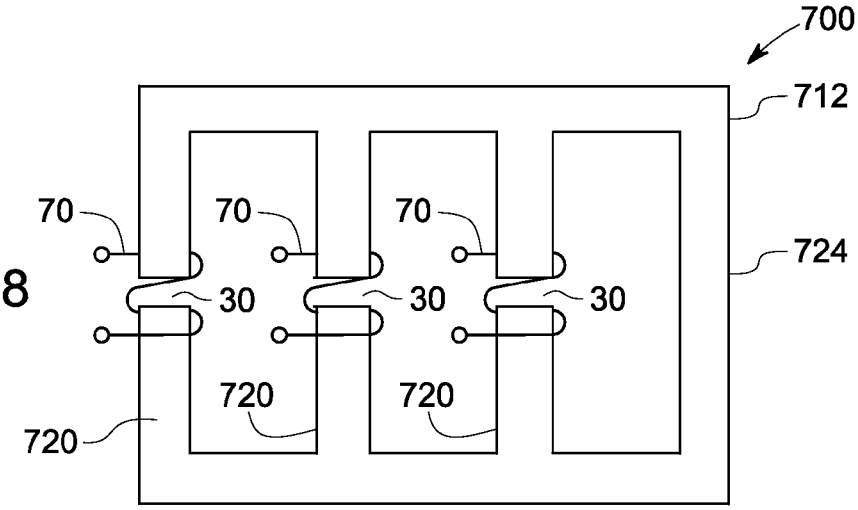
FIG. 8 illustrates a multi-L-C integration structure according to still another embodiment of the invention.

FIG. 8 shows an integration structure 700 according to still another embodiment of the invention. The integration structure 700 includes a magnetic core 712 with multiple legs 720. The integration structure 700 further includes windings 70 wounded on the legs with air gaps 30. At least one leg 724 is substantially solid without an air gap and without a winding. Accordingly, the magnetic flux generated by each winding 70 flows through the at least one leg 724 without affecting other windings. In the illustrated embodiment, each winding 70 is an inductor. In other embodiments, the integration structure 700 may have transformers respectively wound on the legs.

Figure 9:
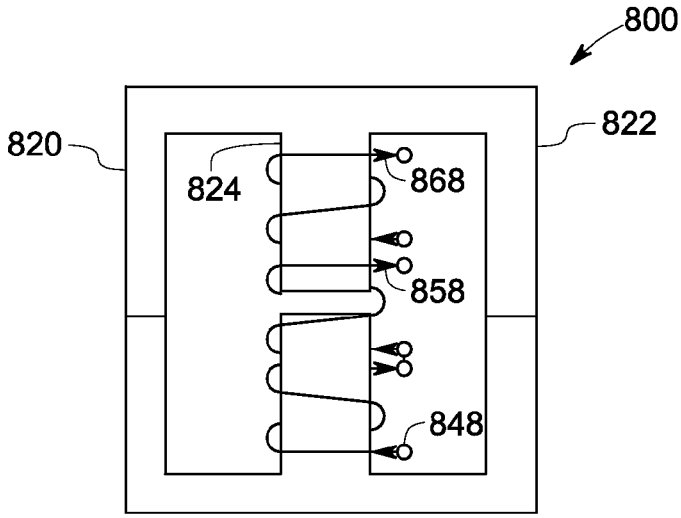
FIG. 9 illustrates an L-C integration structure according to still another embodiment of the invention.

Referring to FIG. 9, an integration structure 800 according to still another embodiment of the invention is shown. The integration structure 800 includes a magnetic core 812. The magnetic core 812 has a first and a second outer leg 820, 822, and a third inner leg 824 between the first and second outer legs 820, 822. The first and second outer legs 820, 822 are substantially symmetric about the third inner leg 824. The integration structure 800 further includes a first and a second winding 848, 858 wound on the third inner leg 824. The first and second windings 848, 858 are electrically coupled with each other and are configured in a manner that magnetic flux respectively generated by the first and second windings 848, 858 has substantially the same magnitude but in an opposite direction. At least one of the first and second windings 848, 858 includes an embedded capacitor C, and thus the first and second windings 848, 858 together function as the capacitor C. The integration structure 800 further includes a third inductive winding 868. The third inductive winding 868 can form an inductor or a transformer. The third inductive winding 868 can be wound on the first or second outer legs 820, 822, or the third inner leg 824.

Figure 10:
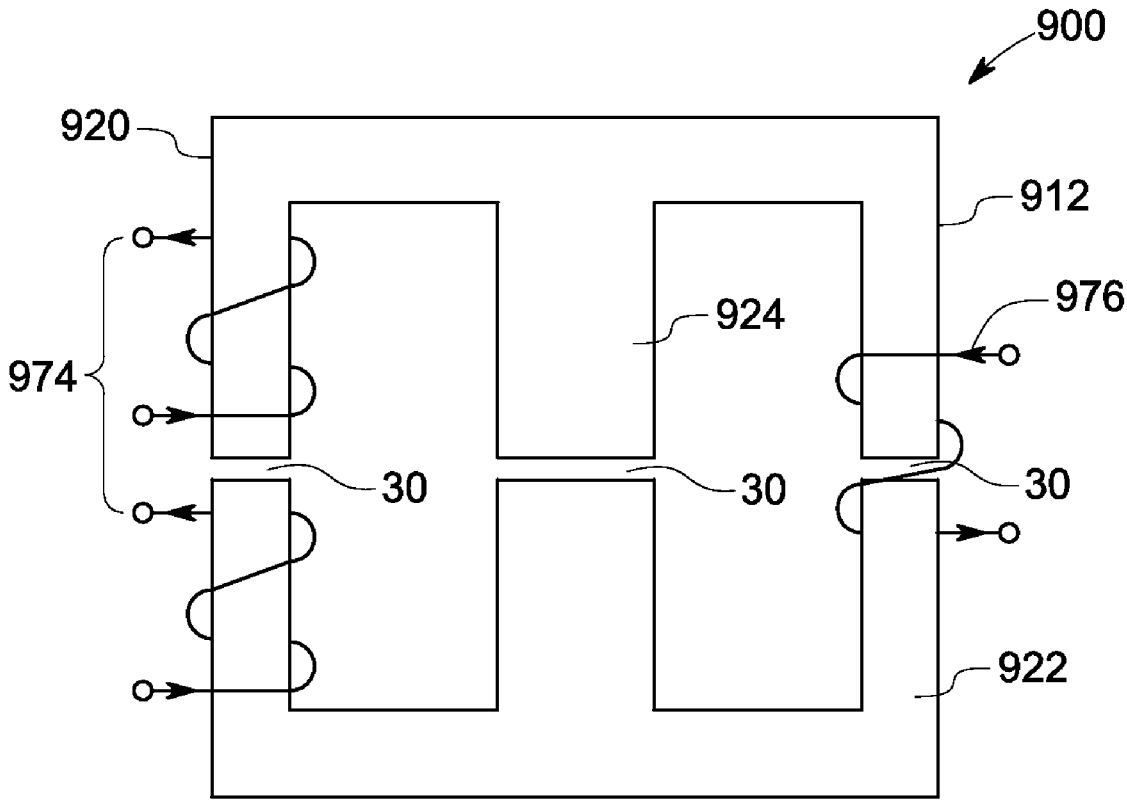
FIG. 10 illustrates an L-C-T integration structure according to still another embodiment of the invention.

Referring to FIG. 10, an integration structure 900 according to still another embodiment of the invention is shown. The integration structure 900 includes a magnetic core 912. The magnetic core 912 includes a first leg 920, a second leg 922 and a third leg 924. The integration structure 900 further includes a first and second inductive winding 974, 976 respectively wound on the first and second legs 920, 922. In the illustrated embodiment, the first inductive winding 974 forms a transformer with an air gap 30, while the second inductive winding 976 forms an inductor. At least one of the first and second windings 974, 976 is a composite winding with an embedded capacitor C. The third leg 924 has an air gap but is without a winding. Magnetic flux generated by the first and the second inductive windings 974, 976 partially flows through the third leg 924, and windings 974, 976 are thus partially decoupled with each other. A ratio of the magnetic flux decoupled can be adjusted by, for example, modifying the distance of the air gap 30 in the third leg 924.

In certain embodiments, the inductive and capacitive components integration structure 100-900 as described above can be applied to electronic ballast, such as CFL and LED lamps, and other power electronics products.

While only certain features of the invention have been illustrated and described herein, many combination, modifications, and changes will occur to those skilled in the art. It is, therefore, to be understood that the appended claims are intended to cover all such modifications and changes as fall within the true spirit of the invention.

The invention claimed is:

1. An inductive and capacitive components integration structure comprising:

a magnetic core including a first and a second outer leg, and a third inner leg between the first and second outer legs;

a first and a second winding respectively wound on the first and second outer legs, the first and second windings being electrically coupled and comprising a first inductive winding, wherein the first inductive winding does not generate any effective magnetic flux through the third inner leg; and a third winding wound on the third inner leg to form a second inductive winding, wherein at least one of the first, second and third windings comprises a composite winding, a cross-section of the composite winding comprising a first and a second conductive windings and a dielectric layer attached to and between the first and second conductive windings, the first and second conductive windings and the dielectric layer further comprising an embedded capacitor.

2. The structure according to claim 1, wherein the second inductive winding does not generate any effective magnetic flux to the first inductive winding.

3. The structure according to claim 1, wherein the first and second outer legs are symmetric about the third inner leg.

4. The structure according to claim 1, wherein the first and second windings comprise an equal number of turns and the same distance between adjacent turns.

5. The structure according to claim 1, wherein both the first and second outer legs have air gaps, and the first and second windings together comprise an inductor.

6. The structure according to claim 1, wherein the third inner leg has an air gap and the third winding comprise an inductor.

7. The structure according to claim 1, wherein at least one of the first, second and third windings is divided into two parts and the two parts are electrically coupled via an electrical connector.

8. The structure according to claim 1 further including a fourth and a fifth winding respectively wound around the first and second outer legs of the magnetic core, the fourth and fifth windings having an equal number of turns and the same distance between adjacent turns and being electrically coupled with each other.

9. The structure according to claim 8, wherein the first, second, fourth and fifth windings together comprise a transformer, the first and second windings together acting as a primary side of the transformer, and the fourth and fifth windings together act as a secondary side of the transformer.

10. The structure according to claim 1 further including a sixth winding, the third and sixth windings respectively acting as a primary and a secondary winding of a transformer.

11. The structure according to claim 10 further including a seventh winding wound around the fourth inner leg, wherein the seventh winding and the third winding have the same configuration, and magnetic flux respectively generated by the third and seventh windings are substantially decoupled with each other.

12. The structure according to claim 1, wherein the magnectic core further includes a fourth inner leg, the first and second outer legs defining a first plane, the third and fourth inner legs defining a second plane which intersects with said first plane to form a three-dimensional cross-sectional shape.

13. The structure according to claim 1, wherein the second inductive winding does not generate any effective magnetic flux through the first inductive winding.

14. An inductive and capacitive components integration structure comprising:

a magnetic core comprising a first and a second outer leg, and a third inner leg between the first and second outer legs, the first and second outer legs being symmetric about the third inner leg;

a first and a second winding wound on the third inner leg, the first and second windings being electrically coupled to each other and being configured such that magnetic flux respectively generated by the first and second windings is substantially equal and opposite, and a cross-section of at least one of the first and second windings comprises a first and a second conductive windings and a dielectric layer attached to and between the first and second conductive windings, the first and second conductive windings and the dielectric layer comprising an embedded capacitor; and an inductive winding wound on the magentic core.

15. The structure according to claim 14, wherein the inductive winding is wound on the third inner leg.

16. The structure according to claim 14, wherein the inductive winding is wound on one of the first and second outer legs.

17. The structure according to claim 14, wherein the third inner leg of the magnetic core comprises an air gap.

18. The structure according to claim 14, wherein one of the first and second outer legs comprises an air gap.

19. The structure according to claim 14, wherein each of the first and second outer legs comprises an air gap.

20. An inductive and capacitive component integration structure comprising:

a magnetic core including a first leg, a second leg and a third leg; and a first and a second winding wound around the first and second legs respectively, wherein the third leg is substantially solid and without a winding, such that magnetic flux generated by the first and second windings flows through the third leg, and the magnetic flux respectively generated by the first and second windings does not influence each other; and wherein at least one of the first and second windings comprises a composite winding a cross-section of the composite winding comprising a first and a second conductive winding and a dielectric layer attached to and between the first and second conductive windings, the first and second conductive windings and the dielectric layer further comprising an embedded capacitor.

21. The structure according to claim 20, further comprising a plurality of legs, a plurality of windings each wound around a corresponding leg, and magnetic flux generated by the windings flows through the third leg.

22. An inductive and capacitive components integration structure comprising:

a magnetic core including a first leg, a second leg and a third leg, the first, second, third legs each comprising an air gap; and a first and a second inductive winding respectively wound around the first and second legs, wherein magnetic flux generated by the first and second inductive windings partially flows through the third leg and the first and second inductive windings at least partially magnetically decoupled; and wherein at least one of the first and second inductive windings comprises a composite winding, a cross-section of the composite winding comprising a first and a second conductive winding and a dielectric layer attached to and between the first and second conductive windings, the first and second conductive windings and the dielectric layer further comprising an embedded capacitor.

* * * * *

UNITED STATES PATENT AND TRADEMARK OFFICE

CERTIFICATE OF CORRECTION

PATENT NO. : 7,974,069 B2
APPLICATION NO. : 12/260447
DATED : July 5, 2011
INVENTOR(S) : Mao et al.

It is certified that error appears in the above-identified patent and that said Letters Patent is hereby corrected as shown below:

Title Page, Item (74), under "Attorney, Agent, or Firm" in Column 2, Line 1, delete "Klindworth" and insert -- Klindtworth --, therefor.

In Column 7, Lines 25-26, in Claim 12, delete "magnectic" and insert -- magnetic --, therefor.

In Column 7, Line 50, in Claim 14, delete "magentic" and insert -- magnetic --, therefor.

Signed and Sealed this
Twenty-fifth Day of September, 2012

David J. Kappos

David J. Kappos
*Director of the United States Patent and Trademark Office*